US007176613B2

(12) United States Patent
Yonezawa et al.

(10) Patent No.: US 7,176,613 B2
(45) **Date of Patent: *Feb. 13, 2007**

(54) ELECTRON TUBE HAVING LINEAR MEMBERS

(75) Inventors: Yoshihisa Yonezawa, Mobara (JP); Yukio Ogawa, Mobara (JP); Yasuhiro Nohara, Mobara (JP)

(73) Assignee: Futaba Corporation, Chiba-ken (JP)

( * ) Notice: Subject to any disclaimer, the term of this patent is extended or adjusted under 35 U.S.C. 154(b) by 227 days.

This patent is subject to a terminal disclaimer.

(21) Appl. No.: 10/737,089

(22) Filed: Dec. 16, 2003

(65) Prior Publication Data

US 2004/0150321 A1 Aug. 5, 2004

(30) Foreign Application Priority Data

Dec. 19, 2002 (JP) ..... 2002-368991

(51) Int. Cl.
*H01J 1/88* (2006.01)

(52) U.S. Cl. ..... 313/495; 313/496; 313/497; 313/272; 313/422; 313/274; 313/277; 313/456

(58) Field of Classification Search ..... None
See application file for complete search history.

(56) References Cited

U.S. PATENT DOCUMENTS

| | | | | |
|---|---|---|---|---|
| 3,784,862 | A | 1/1974 | Yoshitoshi et al. | |
| 3,906,277 | A | 9/1975 | Schade | |
| 4,263,700 | A | 4/1981 | Fujisaki et al. | |
| 5,667,418 | A | 9/1997 | Fahlen et al. | |
| 6,509,693 | B2 * | 1/2003 | Yonezawa et al. | 315/169.3 |
| 6,710,536 | B2 * | 3/2004 | Yonezawa et al. | 313/495 |
| 6,717,350 | B2 * | 4/2004 | Yonezawa et al. | 313/495 |
| 6,856,085 | B2 * | 2/2005 | Yonezawa et al. | 313/495 |
| 2004/0150323 | A1 * | 8/2004 | Yonezawa et al. | 313/495 |

FOREIGN PATENT DOCUMENTS

| | | |
|---|---|---|
| DE | 27-43423 | 4/1979 |
| GB | 2074370 A1 | 10/1981 |
| JP | 04-324236 | 11/1992 |
| JP | 6-88043 | 12/1994 |
| JP | 2002-245925 | 8/2002 |
| JP | 2002-260521 | 9/2002 |

* cited by examiner

*Primary Examiner*—Sikha Roy
(74) *Attorney, Agent, or Firm*—Quarles & Brady LLP

(57) ABSTRACT

A fluorescent display tube is disclosed. In the fluorescent display tube, linear members, such as, for example, wire grids and filament are sustained in a predetermined height, while both ends of each linear member are welded on a metal layer by ultrasonic. The fluorescent display tube includes a metal spacer for fixing the linear member and holding the linear members in an elevated position so that the dead space within the fluorescent display is reduced. The linear members are bonded on an aluminum thin films formed on the glass substrate 111 by way of the aluminum spacer. The aluminum spacer sustains the linear members in a predetermined height. Aluminum spacer acts as a member for fixing the linear member and as a height level holding member.

9 Claims, 10 Drawing Sheets

ELECTRON TUBE HAVING LINEAR MEMBERS

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The present invention relates to an electron tube having a linear member, such as, for example, a cathode filament, a wire grid, a wire damper for the cathode filament or for the wire grid, and a wire spacer for the cathode filament or the wire grid. More particularly, the present invention relates to a fixing structure of the linear member in a fluorescent luminous tube, such as, a fluorescent display tube in which the linear member is mounted within the display tube under tension.

2. Description of the Prior Art

A fluorescent display tube, as an example of a conventional electron tube, will be described with reference to FIGS. 9(*a*) and 9(*b*). FIG. 9(*a*) is a cross-sectional view illustrating a fluorescent display tube taken along the line X2—X2 of FIG. 9(*b*) looking in the direction of the arrow. FIG. 9(*b*) is a cross-sectional view illustrating a fluorescent display tube taken along the line X1—X1 of FIG. 9(*a*) looking in the direction of the arrow.

The fluorescent display tube has a hermetic container formed of substrates 111 and 112 to be opposite to each other, and side plates 121 to 124. The hermetic container contains cathode filaments 23, grids 43, and anode electrodes 31 on which a fluorescent material 32 is deposited. The fluorescent material 32 gives forth fluorescence by electrons emitted from the filament 2. The grid 43 controls electrons emitted from the filament 23.

A pair of aluminum (Al) thin films 211 and 212 for use in a cathode electrode are formed on the substrate 111. One end of the filament 23 is held between the Al thin film 211 and an aluminum (Al) wire 251, while the other end of the filament is held between the Al thin film 212 and an aluminum (Al) wire 252. Both the ends of the filament 23 are welded to the Al thin films 211 and 212, respectively, together with the Al wires 251 and 252 by an ultrasonic bonding. Spacers 261 and 262 sustain the filaments 23 in a predetermined height.

In addition, a pair of aluminum (Al) thin films 611 and 612 for fixing a damper 63 are formed on the substrate 111. One end of the damper 63 is held between the Al thin film 611 and an Al wire 621 while the other end of the damper 63 is held between the Al thin film 612 and an Al wire 622. Both the ends of the wire damper 63 are bonded to the Al thin films 611 and 612, respectively, together with the Al wires 621 and 622 by the ultrasonic bonding. Spacers 641 and 642 sustain the wire damper 63 in a predetermined height. The wire damper 63, as shown in FIG. 9(*b*), is spaced away from the filament 23 as being in no contact with the filament 23. When the filament 23 vibrates, the wire damper 63 touches with the filament 23 for preventing the filament 23 from contacting with other electrodes. The fluorescent display tube shown in FIG. 9 is disclosed in Japanese Patent Laid-open Publication No. 2002-245925.

The conventional fluorescent display tube shown in FIG. 9, requires to dispose therein the filament having one end fixed between the Al thin film 211 and the Al wire 251 and the other end fixed between the Al thin film 212 and the Al wire 252, as well as the spacers 261 and 262 for sustaining filaments in a predetermined elevated level. This results in increasing dead space in the fluorescent display tube, which is obstructive to reduce size of the fluorescent display tube. The dead space further increases if the wire dampers are disposed in the fluorescent display tube as shown in FIG. 9. The dead space still further increases if the liner members, such as, wired grids, or wire spacers for the filaments, are disposed in the fluorescent display tube.

SUMMARY OF THE INVENTION

The present invention has been made in view of the foregoing disadvantages of the prior art.

Accordingly, an object of the invention is to provide a fluorescent luminous tube having the fixing structure of both ends of the linear member and spacer to be integral so as to reduce the dead space of the fluorescent display tube.

In an aspect of the present invention, an electron tube comprises a hermetic container; electrodes mounted inside the hermetic container; metal spacers for sustaining a linear member in a predetermined height and fixing both ends of the liner member; and a pair of metal layers for fixing the metal spacers; the pair of metal layers being formed inside the hermetic container.

In the electron tube according to the present invention, each pair of metal spacers has a groove and both ends of the linear member are held in the grooves, respectively. In an alternative embodiment of the present invention, at least a portion of both ends of the linear member is fixedly embedded in the pair of metal spacers, respectively. The metal spacers and the linear member are arranged in such a way that the axes of the metal plates are in parallel to the axis of the linear member. In an alternative embodiment of the present invention, the metal spacers and the linear member are arranged in such a way that the axes of the metal spacers intersects the axis of the linear member. The linear member comprises a cathode filament, a wire damper, a wire spacer, a wire grid, or a wire getter, and are bonded firmly to the metal spacers arranged in common for a plurality of the liner members by an ultrasonic bonding.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENT

Figure 1A:
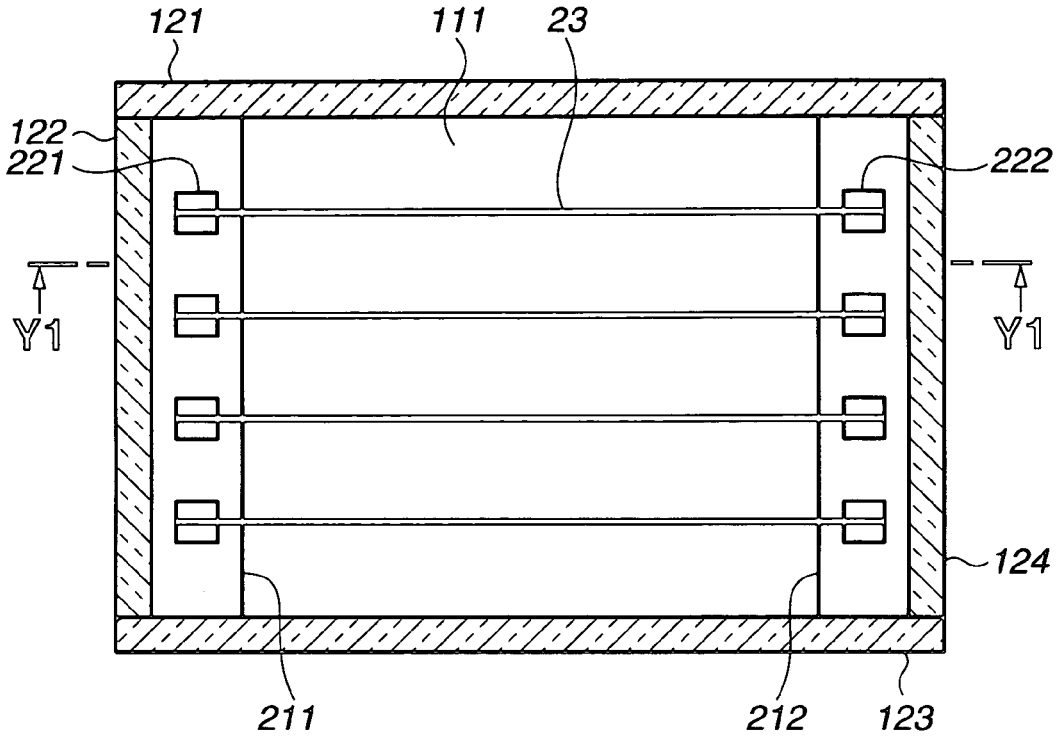
FIGS. 1(*a*) and 1(*b*) are cross sectional views, each illustrating a fluorescent display tube according to a first embodiment of the present invention.

A fluorescent display tube, as an example of an electron tube, according to an embodiment of the present invention will be described hereinafter with reference to FIGS. 1 to 8. Same reference numerals are used to show the common constituent elements. When there are plural same constituent elements, the typical element is indicated by the reference numeral.

Figure 1B:
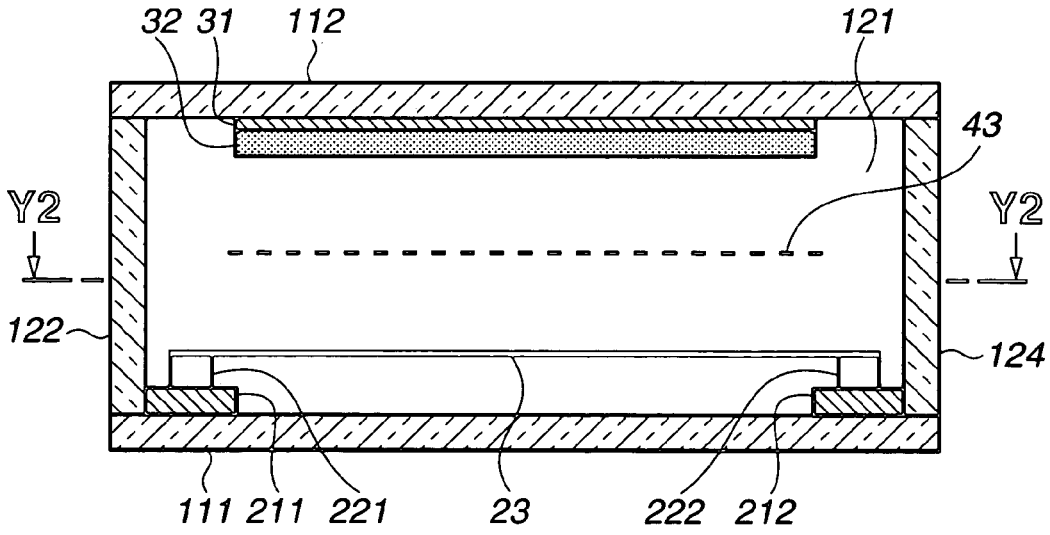
Figure 2A:
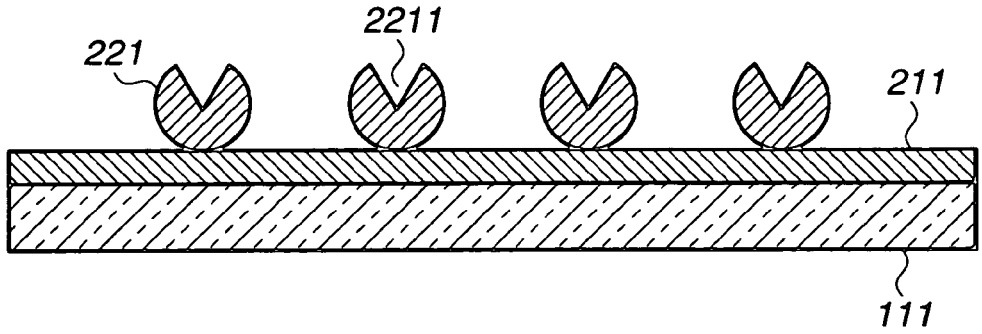
FIGS. 2(*a*), 2(*b*), 2(*c*) and 2(*d*) are diagrams, each explaining the process of bonding filaments by ultrasonic shown in FIG. 1, in which aluminum wires each having a groove are used.
Figure 2B:
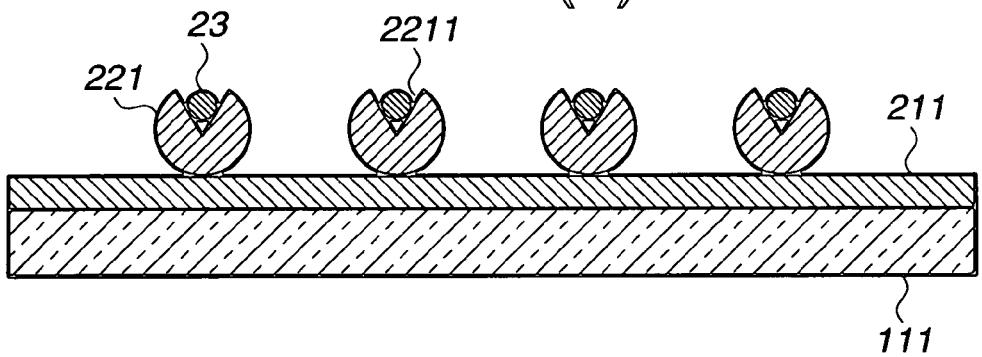
Figure 2C:
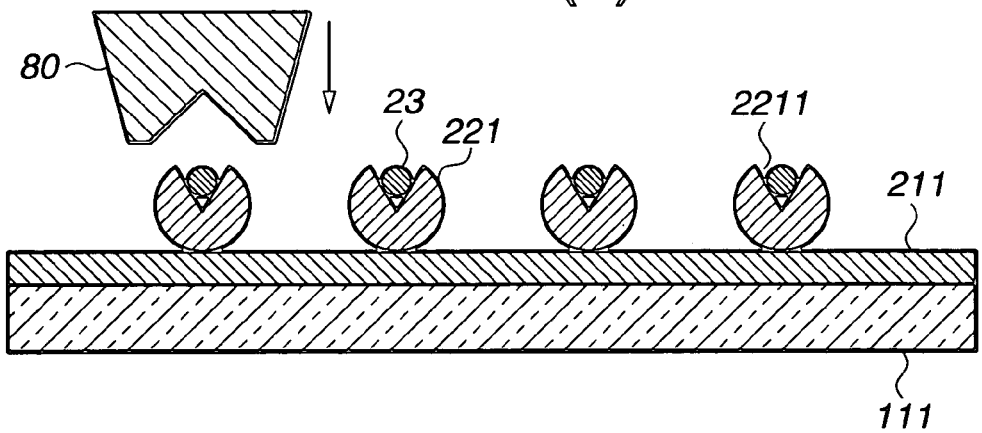
Figure 2D:
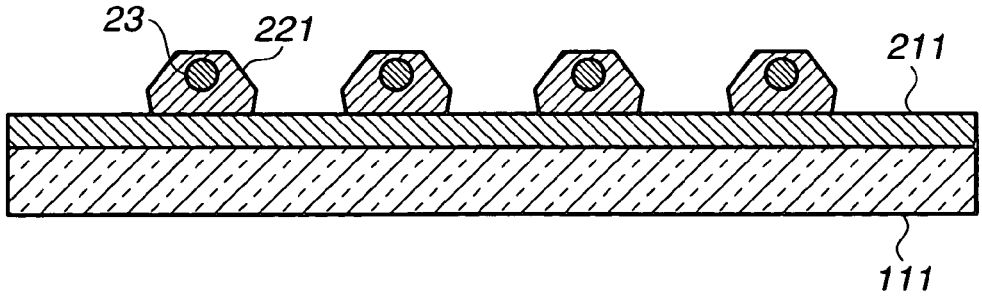

FIG. 1 is a cross sectional view illustrating a fluorescent display tube according to a first embodiment of the present invention. FIG. 1(*a*) is a cross sectional view illustrating a fluorescent display tube taken along the line Y2—Y2 of FIG. 1(*b*) looking in the direction of the arrow. FIG. 1(*b*) is a cross sectional view illustrating the fluorescent display tube of FIG. 1(*a*), taken along the line Y1—Y1 looking in the direction of the arrow.

The fluorescent display tube shown in FIGS. 1(*a*) and 1(*b*) includes a hermetic container formed of a first substrate 111 and a second substrate 112 made of an insulating material, such as, glass, and arranged to be opposite to each other. In order to fabricate the hermetic container, the substrates 111 and 112 are sealed together with side plates 121 to 124 made of an insulating material, such as, glass using a frit glass (not shown). The hermetic container may be fabricated by sealing the substrates 111 and 112 with the frit glass only without using the side plates 121 to 124. In this case, the frit glass portion is called the side plates 121 to 124.

Inside the hermetic container, there are thermionic cathode filaments (linear member) acting as a cathode, grids 43 formed of a metal mesh, and anode electrodes 31 made of a metal having the surface on which a fluorescent material is deposited. The fluorescent material 32 gives forth fluorescence by electrons emitted from the filament 23. The grid 43 controls the electrons emitted from the filament 23. In the fluorescent display tube shown in FIGS. 1(*a*) and 1(*b*), a transparent glass is used at least in the substrate 111 or 112 from which light emission of the fluorescent 32 is viewed.

A pair of aluminum (Al) thin films (metal layers) 211 and 212 for use in cathode electrodes are formed on the substrate 111 common to four filaments 23. A pair of the Al thin films 211 and 212 for use in the cathode electrodes may be formed at the every filament. One end of each filament 23 is welded to the aluminum (Al) wire 221 by ultrasonic bonding, which is, in turn, welded to the Al thin film metal layer 211. The other end of the filament is welded to the aluminum (Al) wire 222 by ultrasonic bonding, which is, in turn, welded to the Al thin film metal layer 212. In this structure, the Al wires 221 and 222 and the filaments 23 are arranged in such a manner that the axes of the Al wires and the filaments in the longitudinal direction are oriented in the same direction (in parallel).

When the filaments 23 are disposed in the fluorescent display tube, the filaments 23 are stretched across a jig (not shown) in advance, and disposed on the Al wire 221 and 222. Thus, the filaments 23 and the Al wires 221 and 222 are fixed together to the Al thin films 221 and 222 at the same time.

In place of the grid 43, an intermediate substrate having electron passing apertures and grid electrodes formed above the substrate adjacent to the apertures may be mounted within the hermetic container so that the filaments may be fixed to the intermediate substrate.

The Al thin films 211 and 212 are formed to have a thickness of 0.1 μm or more by sputtering. The Al wires 221 and 222 having a diameter of 0.1 mm to 1.0 mm can be used, however, an Al wire having of a diameter of 0.5 mm was used in this embodiment. A ternary carbonate (Ba, Sr, Ca), being an electron emission material, coated on a tungsten core, was used for the filament 23. The tungsten core having a thickness of 0.3 MG (or about 10 μm in diameter) to 7.53 MG (or about 50 μm in diameter) can be used, however, a tungsten core having of a thickness of 1.05 MG (or about 10 μm in diameter) was used in this embodiment. The tungsten core having a diameter of 30 μm was used after coating an electron emitter material. It is desirable that the ratio of the diameter of the core of the filament 23 to the diameter of the Al wires 221 and 222 is about 1:4.

The spacing between each filament 23 and the substrate 111 is set to about 0.3 mm. The spacing between filaments 23 is set to 0.8 mm to 3 mm. In place of the Al thin films 211 and 212, thick films of 10 μm or more may be formed on the substrate by a thick film printing.

The Al wires 221 and 222 act as a fixing member of the filaments 23, as well as a spacer for sustaining filaments 23 in a predetermined height. The Al wires can be eliminated to provide the space to place the conventional spacer on each end of the filament. Thus, the dead space in the fluorescent display tube can be reduced so that a compact the fluorescent display tube can be obtained. Furthermore, the fabrication process can be simplified, because the conventional spacer fixing step is not required. Also, the number of components can be decreased, which results in reduction of fabrication costs of fluorescent display tubes.

Referring to FIG. 1, the Al wires 221 and 222 and the filaments 23 are arranged in such a manner that the axes thereof are oriented in the same direction (in parallel). Thus, the Al wires 221 and 222 can be arranged more closely to be adjacent to each other. As a result, the filaments 23 of the fluorescent display tube shown in FIG. 1 can be arranged in a fine pitch. A margin of about 1 mm is enough for the spacing between each Al wire piece 221 and the side plate 122 and for the spacing between each Al wire piece 222 and the side plate 124 so that the dead space can be reduced.

FIG. 2 is a diagram explaining the method of bonding filaments by ultrasonic shown in FIG. 1, in which the Al wires each having a groove are used.

Al wires 221 each having a groove 2211 are temporarily fixed to the Al thin film layer 211 overlying the substrate 111 by ultrasonic bonding (FIG. 2(*a*)). An end of filament 23 is inserted into the groove 2211 (FIG. 2(*b*)). Then, an ultrasonic bonding tool (a wedge tool) 80 is pushed against the Al wire 221 in the direction of the arrow and applies ultrasonic waves to it (FIG. 2(*c*)). Thus, the Al wire 221 and the filament 23 are bonded to the Al thin film 221 (FIG. 2(*d*)), and the filament 23 embedded in the Al wire 221 is securely fixed. The ultrasonic bonding tool 80 shown in FIG. 2 is sequentially moved to bond the following every filament 23. However, the bonding tool capable of welding plural filaments at the same time can be employed. The ultrasonic power of the ultrasonic bonding machine was set to 15 W and the load of the ultrasonic bonding tool was set to 1,100 g and the bonding time was set to 250 msec.

In FIG. 2(*a*), grooves 2211 can be formed after Al wire 221 is temporarily fixed on the Al thin film 211 overlying the substrate 111. It is to be understood that the Al wire 221 is not always required to be fixed in advance on the Al thin film 211. The temporarily fixing step is advantageous in that the Al wire 221 stabilizes and facilitates the processing. In the filament 23, a ternary carbonate is coated on the core thereof. However, the ternary carbonate coated on the portion to be bonded may be removed in advance or may not be removed, because it is easily rubbed off upon bonding.

In the embodiment shown in FIG. 2, the bonding strength between the Al thin film 211 and the Al wire 221 was 20 N. The wire breaking strength of the filament 23 was 0.5 N. Thus, the bonding strength is larger than the wire breaking strength of the filament 23. In FIG. 2(*a*), the Al wire 221 cut in a predetermined length in advance in the shape of a metal piece was used. However, it may be cut in a required length after the bonding wire is bonded to the Al thin film by ultrasonic.

Figure 3A:
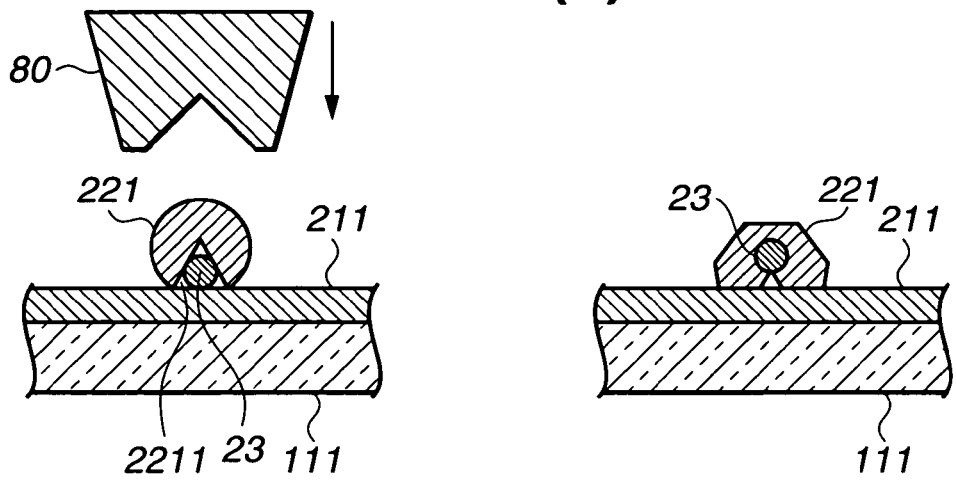
FIGS. 3(*a*), 3(*b*), and 3(*c*) are diagrams, each illustrating the groove of an aluminum wire shown in FIG. 2, which are oriented in different directions.
Figure 3B:
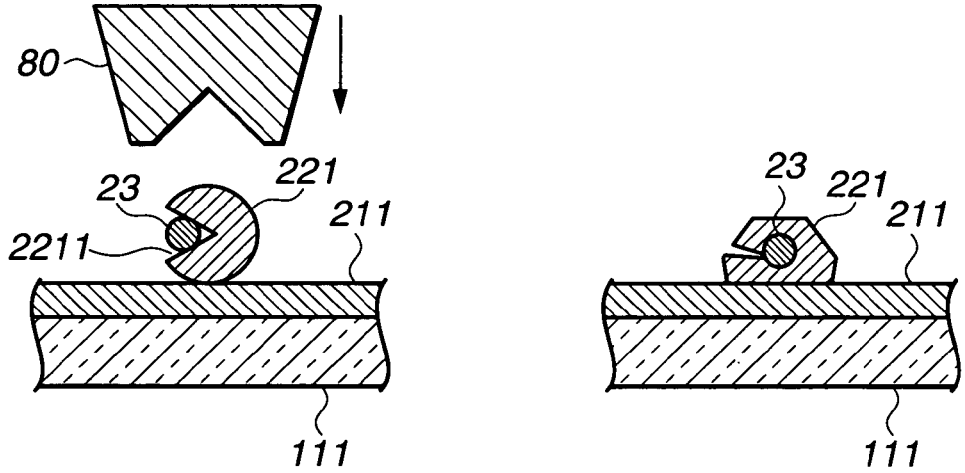
Figure 3C:
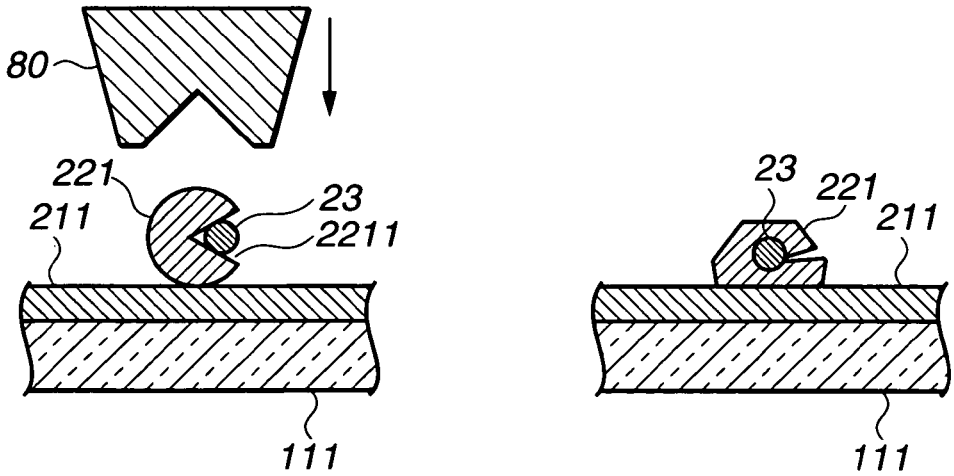
Figure 4A:
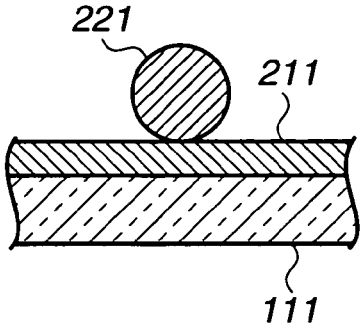
FIGS. 4(*a*), 4(*b*), 4(*c*), 4(*d*) and 4(*e*) are diagrams, each explaining the ultrasonic bonding process of the filament shown in FIG. 1, in which an aluminum wire with no groove is used.
Figure 4B:
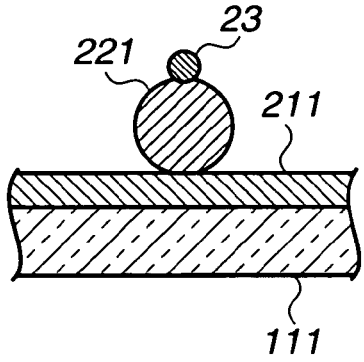
Figure 4C:
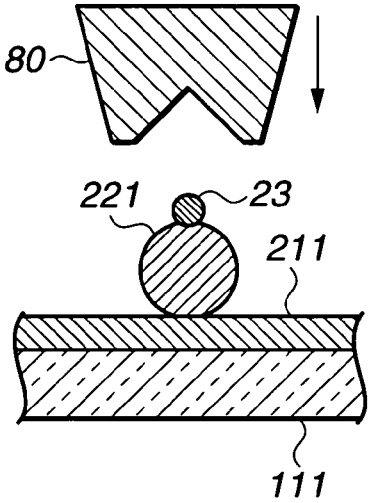
Figure 4D:
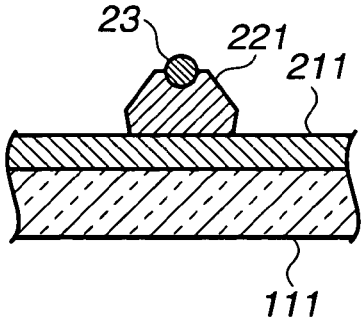
Figure 4E:
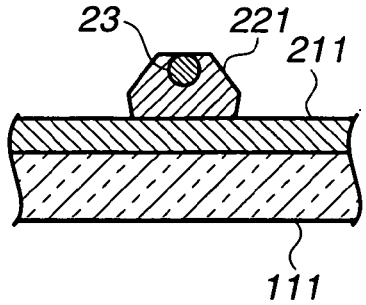
Figure 5A:
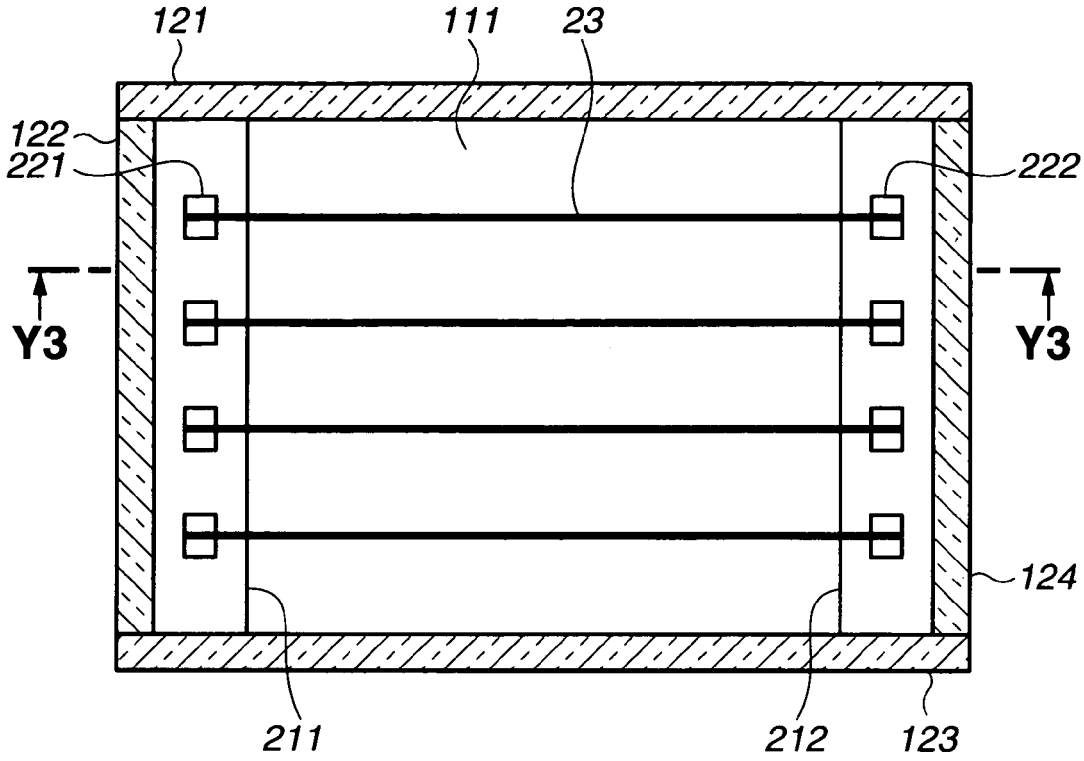
FIGS. 5(*a*), 5(*b*), 5(*c*), and 5(*d*) are cross sectional views, each illustrating a fluorescent display tube according to a second embodiment of the present invention.
Figure 5B:
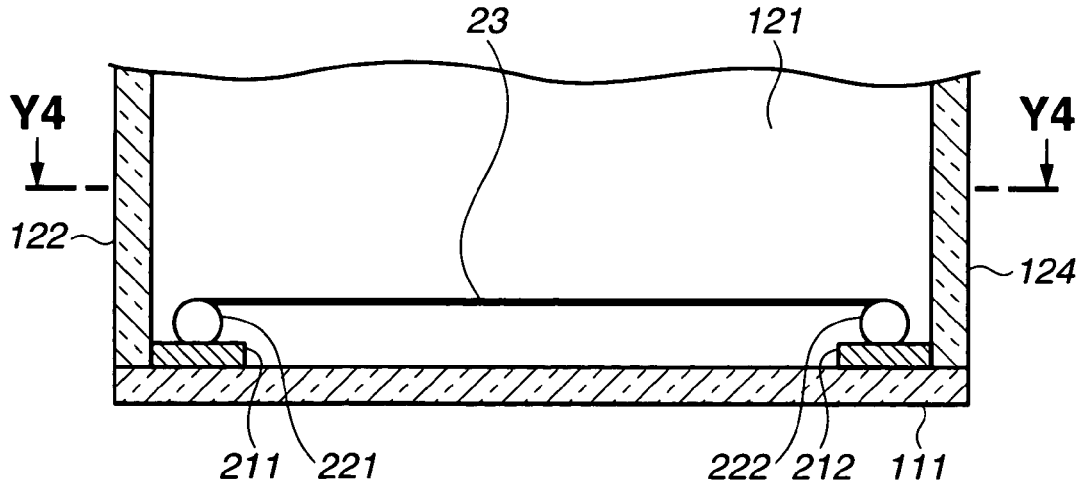
Figure 5C:
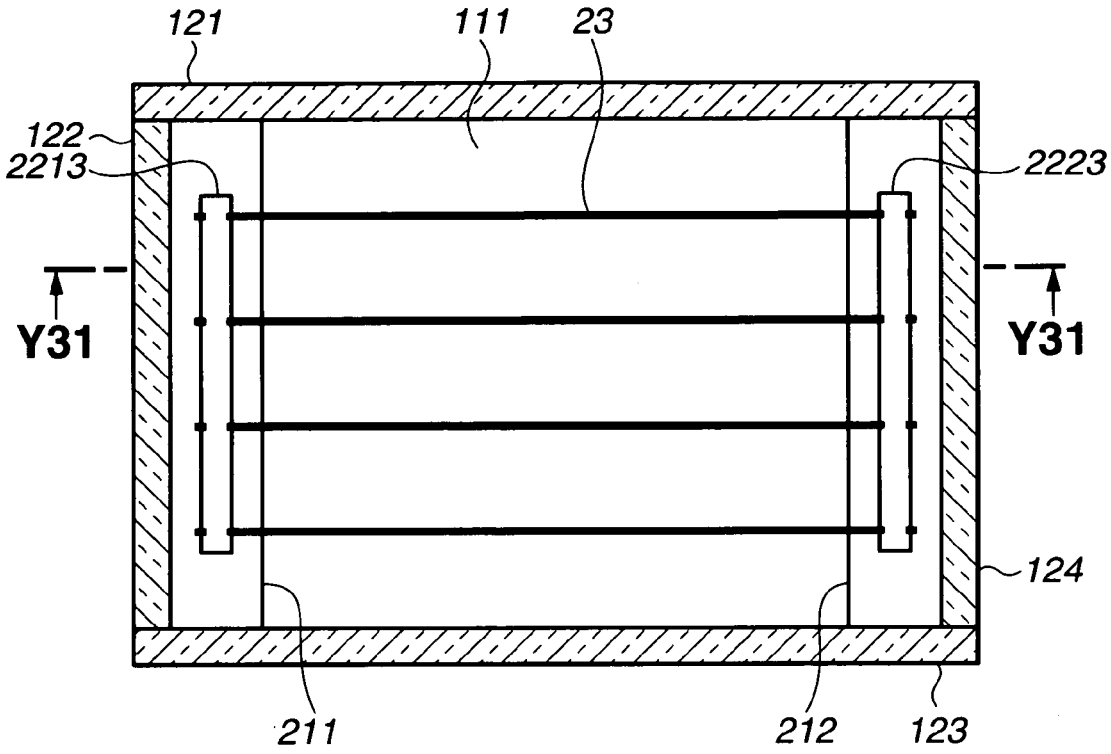
Figure 5D:
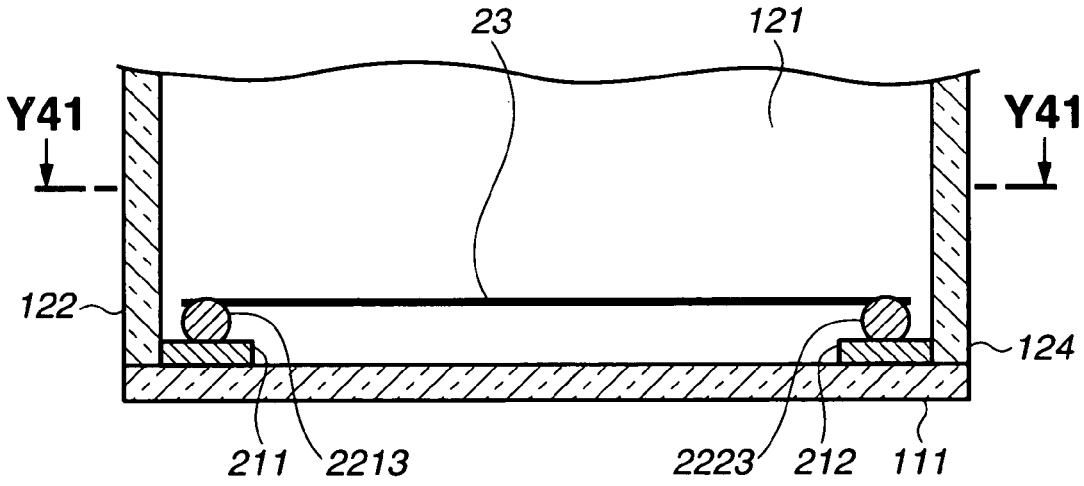
Figure 6A:
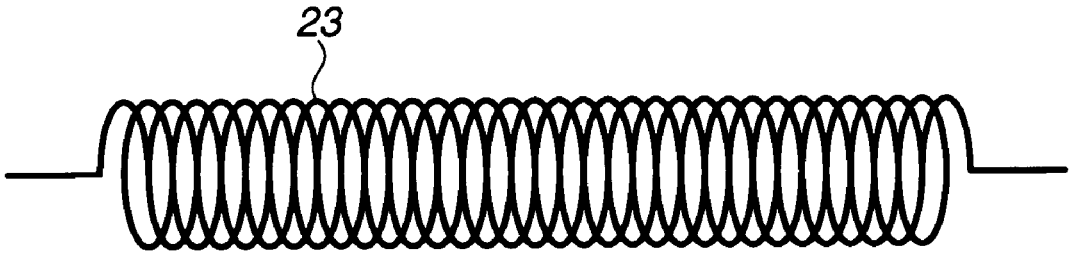
FIGS. 6(*a*), 6(*b*), 6(*c*) and 6(*d*) are diagrams, each illustrating a shape of a filament in detail used in the fluorescent display tubes of FIGS. 1 and 5.
Figure 6B:
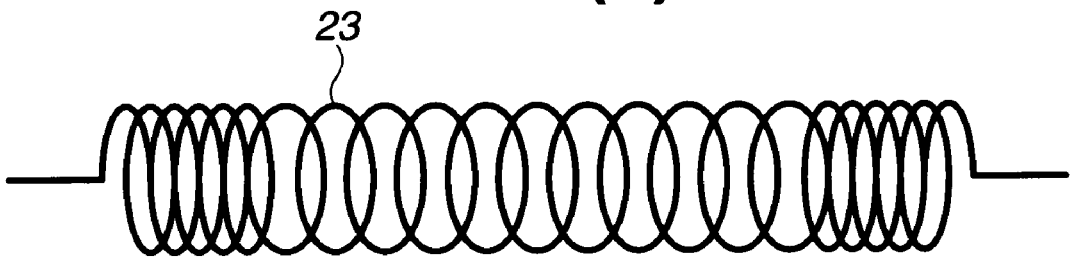
Figure 6C:
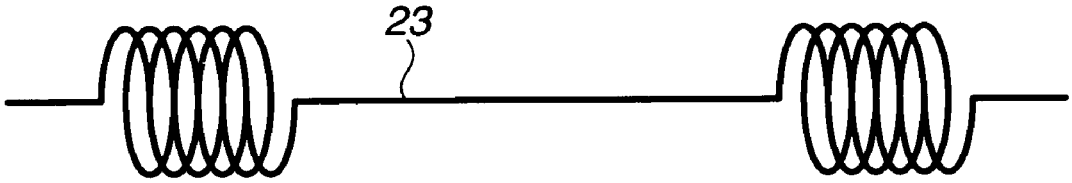
Figure 6D:
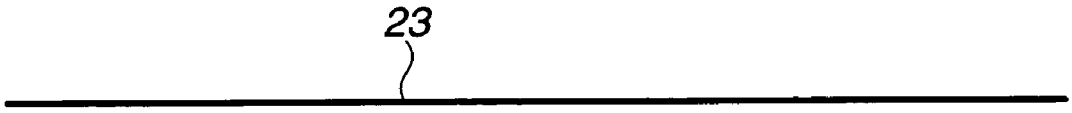

FIG. 3 shows variations, in which the direction of the groove 2211 of the Al wire 221 shown in FIG. 2 is changed. On the left sides of FIGS. 3(*a*) to 3(*c*), the ultrasonic bonding tool 80 is pushed against the Al wire 221 and applies ultrasonic waves thereto. Each of the right sides of the FIGS. 3(*a*) to 3(*c*) shows completion of the bonding step.

More specifically, FIG. 3(*a*) shows an example of the groove 2211 of the Al wire 221 directed toward the side of the Al thin film 211. In this example, the Al wire 221 may be fixed to an end of the filament 23 in advance. Thus, both the Al wire 221 and the filament 12 are bonded to the Al thin film 211 at the same time. Alternatively, the Al wire 221 may be temporarily bonded to the Al thin film 211 by ultrasonic bonding and then the end of the filament may be inserted in the groove 2211 of the temporarily bonded Al wire 221. FIGS. 3(*c*) and 3(*c*) show examples in which the groove 2211 of the Al wire 221 is formed sideways (or in parallel to the Al thin film 211). The Al wire 221 is fixed to the end of the filament 23 in advance. Then, both the elements are bonded to the Al thin film 211 at the same time.

FIG. 4 is a diagram explaining the step of ultrasonic bonding the filament of FIG. 1 and shows the example of using the Al wire with no groove. In the embodiment shown in FIG. 4, the Al wire 221 is fixed in advance to the Al thin film 211 overlying the substrate 111 (FIG. 4(*a*)). An end of the filament 23 is disposed on the temporary fixed Al wire 221 (FIG. 4(*b*)). Then, the ultrasonic bonding tool 80 is pushed against the Al wire 221 and the filament 23 in the direction of the arrow and applies ultrasonic waves thereto (FIG. 4(*c*)). Then, both the Al wire 221 and the filament 231 are welded to the Al thin film 211 at the same time (FIG. 4(*d*) or FIG. 4(*e*)).

FIG. 4(*d*) shows an example where a portion of the filament 23 is embedded while being exposed from the surface of the Al wire 221. FIG. 4(*e*) shows an example where the filament 23 is completely embedded into the Al wire 221. The degree of embedding the filament 23 into the Al wire 221 depends on the ultrasonic wave output of the ultrasonic bonding machine, the bonding time or the loading. As is apparent from the examples shown in FIGS. 4(*d*) and 4(*e*), the degree of embedding the filament changes according to differences in ultrasonic wave output, bonding time or loading. It is to be understood that the Al wire 21 is not always required to be fixed in advance to the Al thin film 211. The temporary fixing step facilitates the process of fixing the filament 23, because the Al wire 221 does not move. The Al wire 221 with no groove shown in FIG. 4 simplifies the wire structure, thus resulting in the reduction of fabrication costs.

In the ultrasonic bonding process shown in FIGS. 2 to 4, when the Al wire 221 of the same diameter is used, the spacing, namely, the distance between the substrate 111 or the Al thin film 211 and the filament 23 depends on the bonding condition. The bonding condition includes the shape of the pressure surface or the depth of the recess of the ultrasonic bonding tool 80, the ultrasonic output of the ultrasonic bonding machine, the load to the ultrasonic bonding tool, or the bonding time. For example, the spacing between the substrate 111 and the filament 23 depends on the shape of the pressure surface, particularly the depth of the recess of the ultrasonic bonding tool 80, if the bonding condition is the same. In this case, the Al wire 221 spreads in the recess and a protrusion is formed. The depth of the recess depends on the height of the protrusion. If the shape of the pressure surface or depth of the recess of the ultrasonic bonding tool 80 is the same, the spacing between the substrate 111 and the filament 23 is determined by the bonding condition. In this case, the spreading of the Al wire over the substrate depends on the bonding condition. The degree of the spreading changes the thickness of the Al wire 221.

FIG. 5(*a*) and FIG. 5(*b*) are cross-sectional views illustrating a fluorescent display tube according to a second embodiment of the present invention. FIG. 5(*a*) is a cross-sectional view illustrating a fluorescent display tube taken along the line Y4—Y4 of FIG. 5(*b*) looking in the direction of the arrow. FIG. 5(*b*) is a cross-sectional view illustrating a fluorescent display tube taken along the line Y3—Y3 of FIG. 5(*a*) looking in the direction of the arrow. FIGS. 5(*c*) and 5(*d*) show an example that the lengths of Al wire 221 and 222 in FIGS. 5(*a*) and 5(*b*) are changed. FIG. 5(*c*) is a cross-sectional view illustrating a fluorescent display tube taken along the line Y41—Y41 of FIG. 5(*d*) looking in the direction of the arrow. FIG. 5(*d*) is a cross-sectional view illustrating a fluorescent display tube taken along the line Y31—Y31 of FIG. 5(*c*) looking in the direction of the arrow. In FIG. 5, like numerals are used to show the same constituent elements and thus the duplicate explanation will be omitted.

In the fluorescent display tubes shown in FIGS. 5(*a*) and 5(*b*), the Al wire 221 and 222 are disposed in such a way that the axes thereof intersect the axis of the filament 23. In this filament 23, one end is securely bonded on the Al wire 221 and the other end is securely bonded on the Al wire 222. This arrangement facilitates the fixing work of the filament 23.

In the fluorescent display tube shown in FIGS. 5(*c*) and 5(*d*), one end of the filament 23 is fixed to the Al wire 2213 and the other end is fixed to the Al wire 2223. In other words, the Al wire 2213 is fixed to the Al thin film 211 overlying the substrate 111 and the Al wire 2223 is fixed to the Al thin film 212 overlying the substrate 111. A groove is formed in the Al wires 2213 and 2223 at the position where the filament 23 is fixed to the Al wires 2213 and 2223. Then, each end of the filament 23 is inserted into the grooves and is bonded to the Al wires 2213 and 2223 by ultrasonic bonding. The groove forming step and the filament bonding step may be effected separately or may be effected altogether. In this instance, it is not required to cut the Al wire into an individual piece. This shortens the working time when filaments 23 are arranged in a fine pitch. The Al wires 2213 and 2223 can be used as a cathode electrode, and compensate the current capacity of the Al thin films 211 and 212. As a result, the widths of the Al thin films 211 and 212, and the space where Al thin films 211 and 212 are formed can be reduced. This is applicable to the wire grids.

The Al wires 2213 and 2223 are formed in common to all the filaments 23. However, Al wire may be divided into plural pieces for fixing plural filaments to each piece of Al wire. For example, the filament may be divided into two sets each including two filaments 23 arranged horizontally and the Al wire may be provided at each set of the filaments.

FIG. 6 shows a detailed structure of the filament 23 for use in the fluorescent display tube of FIG. 2. The filament 23 shown in FIG. 6(*a*) is formed in a coil shape wound at the same pitch. The filament 23 shown in FIG. 6(*b*) is formed in a coil shape wound at a partially different pitch. The filament 23 shown in FIG. 6(*c*) is formed of a coil section and a straight section. The filament 23 shown in FIG. 6(*d*) is formed of a straight section over the length.

The filament 23 is formed of a core, such as, tungsten wire or tungsten alloy wire (W, Re), on which an electron emission material (Ba, Sr, Ca) is coated.

A coil section is formed on the linear member to apply tension to the linear member. The applied tension prevents the linear member, such as a cathode filament, from contacting with the electrodes such as the grid, due to expansion of the filament when it is electrically heated. This is applicable to the case where the linear member is used as a wire grid. When the linear member is used as a filament damper, the coil section is not required, because of no need of electric heating in the filament damper.

Figure 7A:
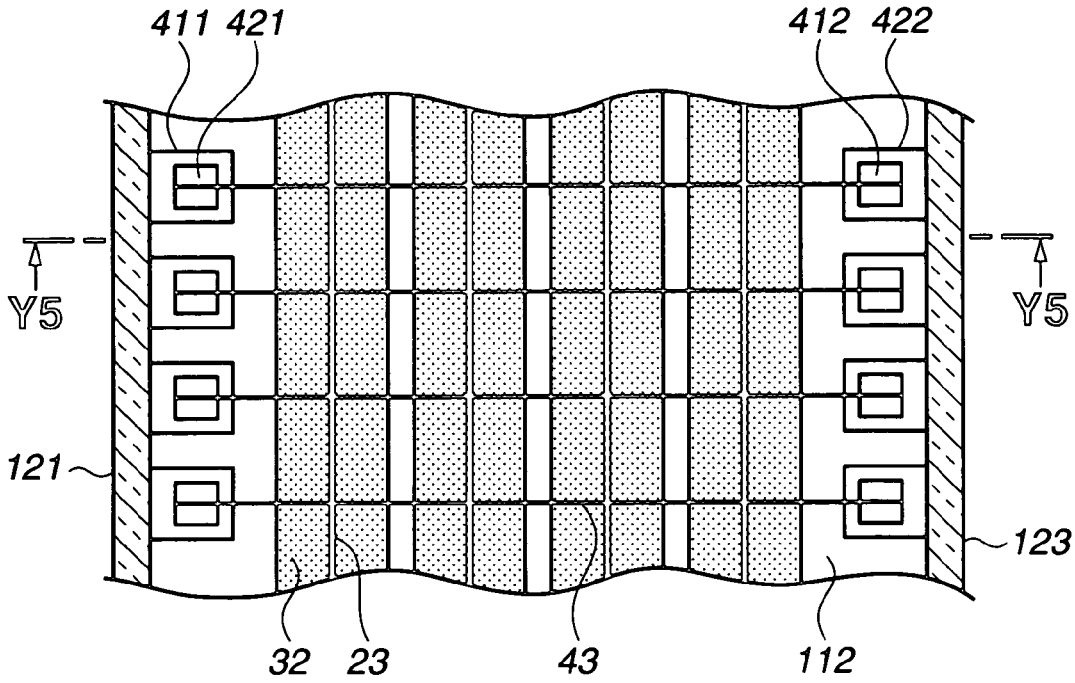
FIGS. 7(*a*) and 7(*b*) are cross sectional views, each illustrating a fluorescent display tube according to a third embodiment of the present invention.
Figure 7B:
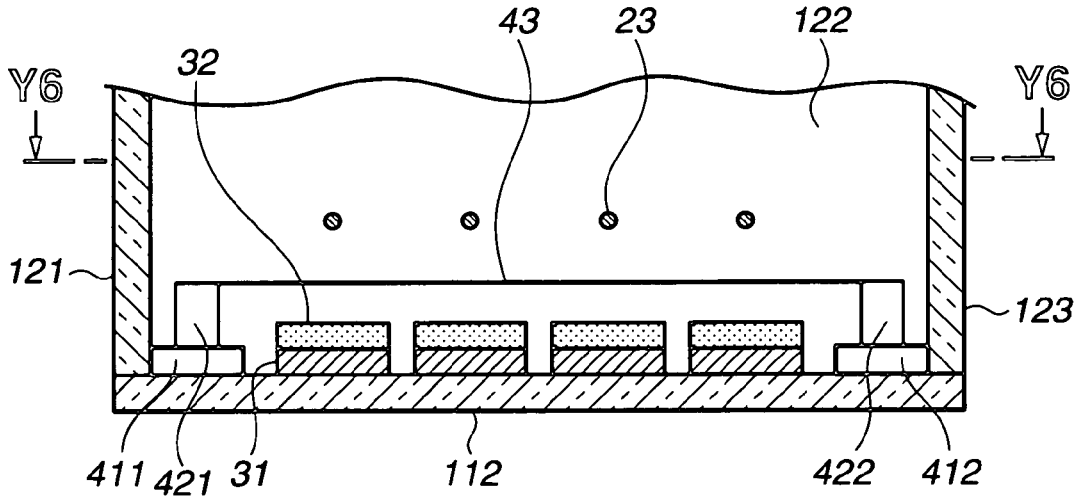

FIG. 7 is a cross sectional view illustrating a fluorescent display tube according to a third embodiment of the present invention. FIG. 7(*a*) is a cross sectional view illustrating a fluorescent display tube taken along the line Y6—Y6 looking in the direction of the arrow. FIG. 7(*b*) is a cross sectional view illustrating a fluorescent display tube taken along the line Y5—Y5 looking in the direction of the arrow.

In the fluorescent display tube shown in FIG. 7, the grid is formed of a linear wire grid 43. The filament 23 is fixed to the substrate 111 (not shown) in a manner similar to that fluorescent display tube shown in the FIGS. 1 and 5.

In the wire grid 43, one end is bonded to the linear Al wire 421 as a grid electrode, which is, in turn bonded to the Al thin film metal layer 411 by ultrasonic. The other end is bonded to the linear Al wire 422, as a grid electrode, which is, in turn bonded to the Al thin film metal layer 412 by ultrasonic. The Al wires 421 and 422 and the wire grid 43 are arranged in such a way that the axes of them are in the same direction (in parallel). The wire grid 43 may be made of a wire of W, Mo, stainless wire, SUS 430 alloy wire, 423 alloy (made of Ni of 42%, Cr of 6%, remainder Fe) wire, or the like.

The Al wires 421 and 422 for fixing the wire grid 43 acts as a spacer for holding the wire grid 43 in a predetermined height. This eliminates the space for arranging the conventional spacer provided at the ends of the wire grid. Accordingly, the dead space in the fluorescent display tube can be reduced so that the fluorescent display tube of smaller size can be provided. The omission of the conventional spacer fixing step in the fluorescent display tube simplifies the fabrication process and reduces the fabrication costs of the fluorescent display tube, because of the reduced number of components.

In the embodiment shown in FIG. 7, the Al wires 421 and 422 and the wire grids 43 are arranged such that the axes thereof are in the same direction, which makes it possible to narrow the spacing between the neighboring Al wires 421 and 422. Accordingly, the wire grid 43 shown in FIG. 7 can be arranged at a fine pitch. The spacing between the Al wire 421 and the side plate 121 and the spacing between the Al wire 422 and the side plate 123 can be set to about 1 mm. In this structure, the dead space can be significantly reduced. The Al wires 421 and 422 and the wire grids 43 may be arranged in such a way that the axes thereof intersect.

Figure 8A:
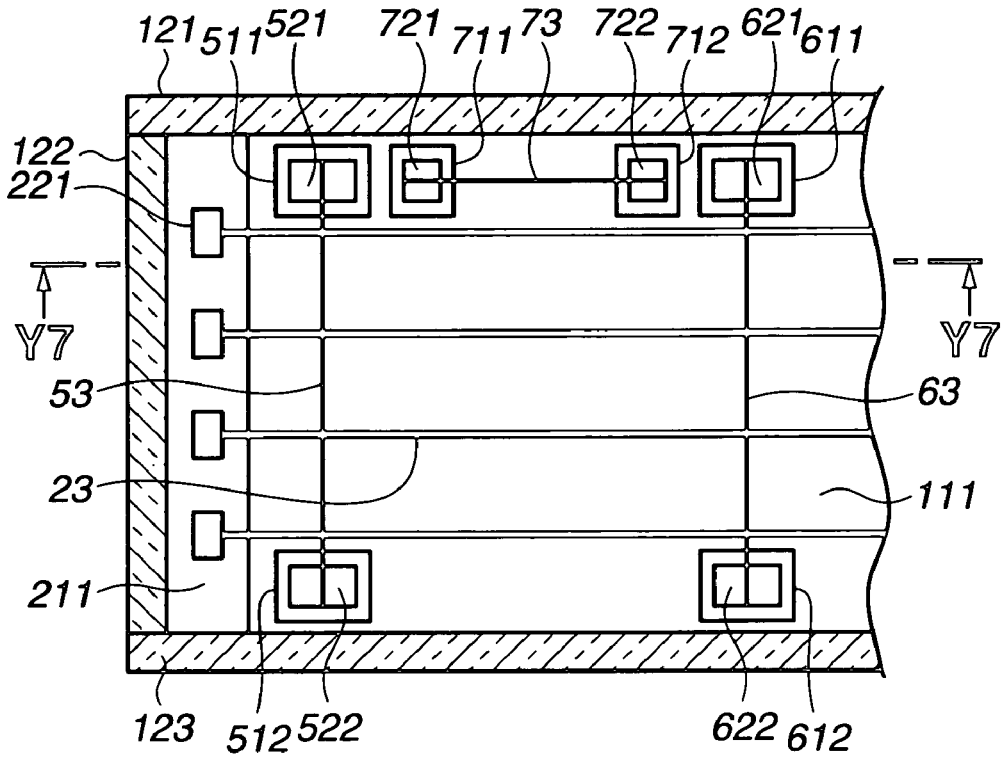
FIGS. 8(*a*) and 8(*b*) are cross sectional views, each illustrating a fluorescent display tube according to a fourth embodiment of the present invention.
Figure 8B:
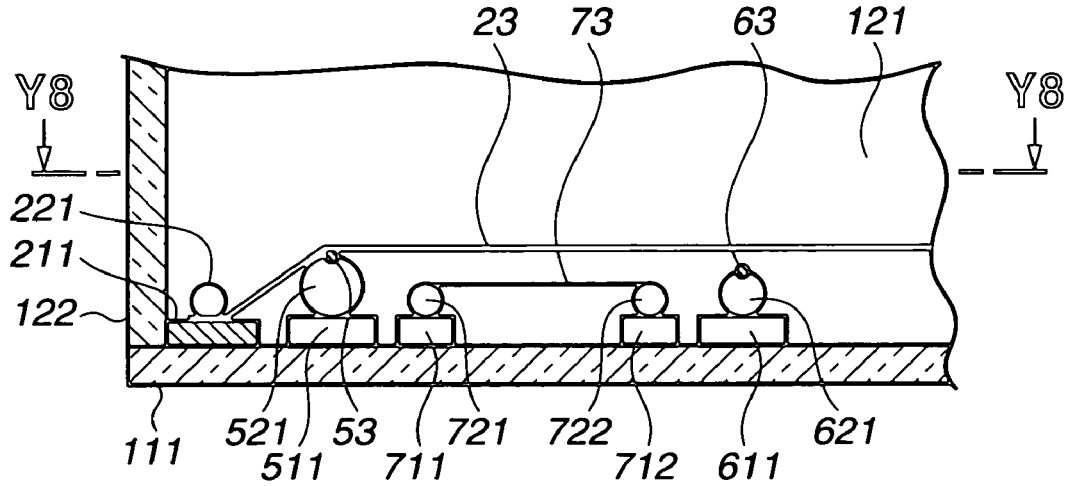
Figure 9A:
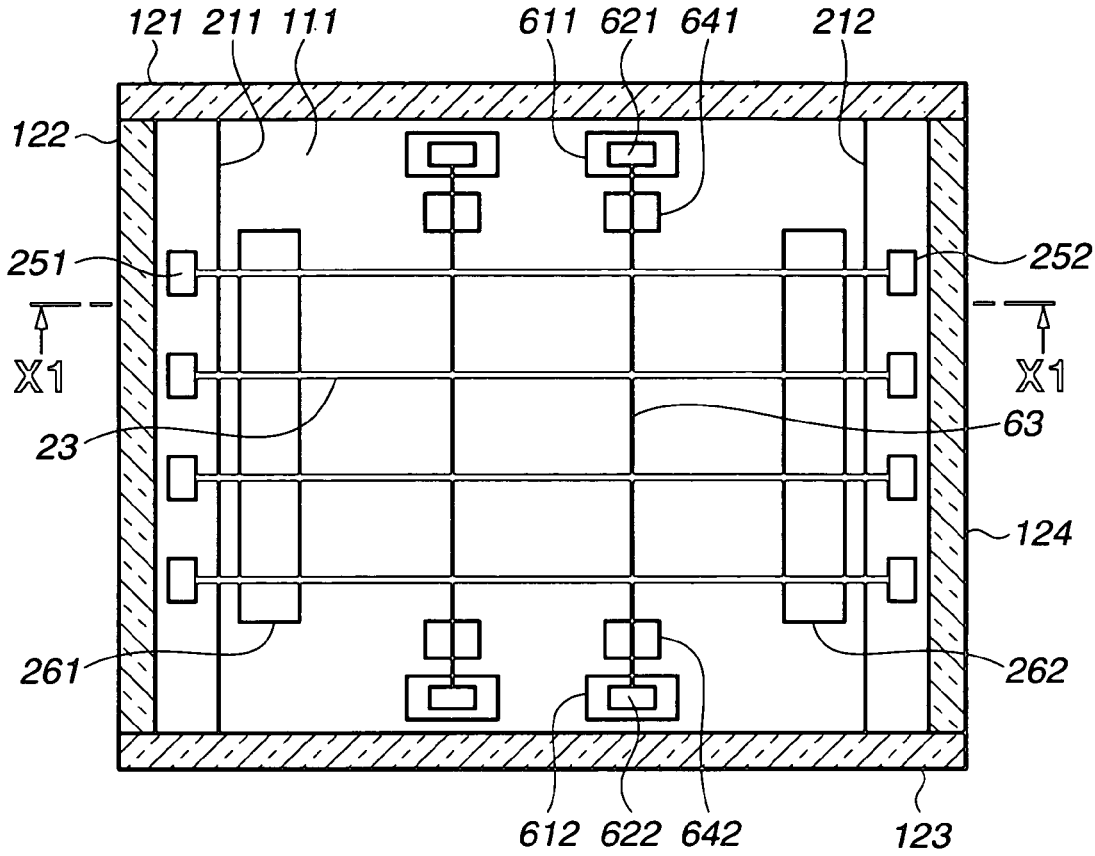
FIG.9(a) (PRIOR ART)
FIGS. 9(*a*) and 9(*b*) are cross sectional views, each illustrating a conventional display tube.
Figure 9B:
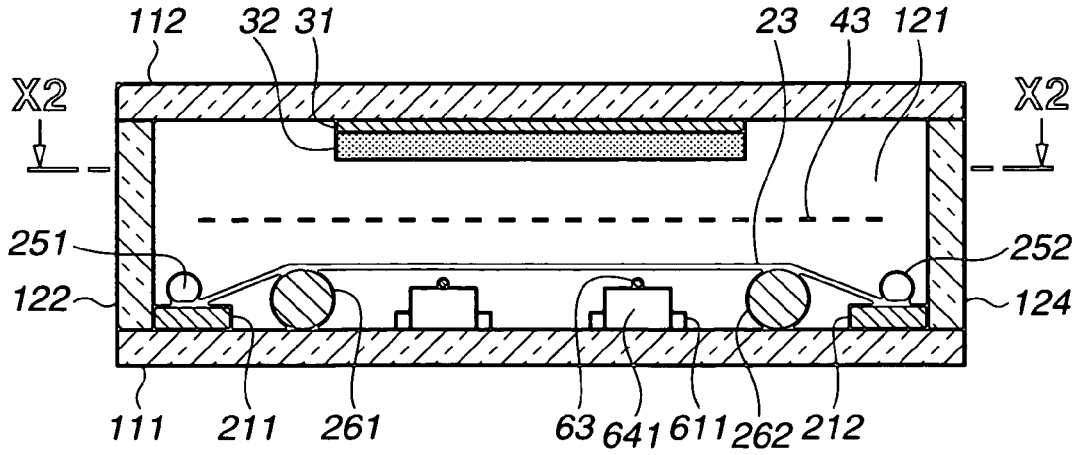
FIG.9(b) (PRIOR ART)

FIG. 8 is a cross sectional view illustrating a fluorescent display tube according to a fourth embodiment of the present invention. FIG. 8(*a*) is a cross sectional view illustrating the fluorescent display tube of FIG. 8(*b*) taken along the line Y8—Y8 looking in the direction of the arrow. FIG. 8(*b*) is a cross sectional view illustrating the fluorescent display tube of FIG. 8(*a*) taken along the line Y7—Y7 looking in the direction of the arrow.

The fluorescent display tube shown in FIG. 8 is provided with linear members, such as, wire spacers 53 for the filaments 23, wire dampers 63 for the filaments 23, and a wire getter 73. The filament 23 is in contact with the wire spacer 53 and is sustained in a predetermined height. A wire damper 63, which is disposed between a pair of wire spacers 53 disposed adjacent to the filament 23, prevents the filament 23 from contacting with other electric components, due to vibration of the filament 23.

One end of the wire spacer 53 is bonded firmly to the Al thin film metal layer 511, as a spacer fixture, by means of the Al wire metal spacer 521 by ultrasonic bonding. In the same manner, the other end of the wire spacer 53 is bonded firmly to the Al thin film metal layer 512, as a spacer fixture, by means of the Al wire metal spacer 522 by ultrasonic bonding. Similarly, one end of the wire damper is bonded firmly to the Al thin film metal layer 611, as a spacer fixture, by means of the Al wire metal spacer 621 by ultrasonic bonding. The other end of the wire damper is bonded firmly to the Al thin film metal layer 612, as a spacer fixture, by means of the Al wire metal spacer 622 by ultrasonic bonding. In the getter 73, one end is bonded firmly to the Al thin film metal layer 711, as a spacer fixture, by means of the Al wire metal spacer 721 by ultrasonic bonding. The other end of the getter 73 is bonded firmly to the Al thin film metal layer 712, as a spacer fixture, by means of the Al wire metal spacer 722 by ultrasonic bonding.

In the embodiment shown in FIG. 8, the wire dampers 63, each having a diameter of approximately 40 μm, are arranged at the interval of 10 mm to 20 mm. In FIG. 8, the Al wire 521 is bonded to one end of the wire spacer 53 and the Al thin film 511, and the Al wire 522 is bonded to the other end of the wire spacer 53 and the Al thin film 512. The Al wires 521 and 522 hold the wire spacer 53 suspended at a predetermined height. The Al wire 621 is bonded to one end of the wire damper 63 and the Al thin film 611 and the Al wire 621 is bonded to the other end of the wire damper 63 and the Al thin film 612. The Al wires 621 and 622 hold the wire damper 63 suspended at a predetermined height. Accordingly, the fluorescent display tube of the present invention eliminates the need to provide the space for installing the conventional spacers to be disposed on both ends of the wire spacer or the wire damper. Thus, the dead space in the fluorescent display tube can be reduced so that the fluorescent display tube of smaller size can be provided. According to the present invention, the conventional spacer fixing process is not required, which simplifies the fabrication process of the fluorescent display tube. Also, the smaller number of components can reduce the fabrication cost of the fluorescent display tube.

Similarly, the spacer installation space for the wire getter 73 is not required. The wire getter 73 in a straight form can form a getter mirror in the elongate space inside the fluorescent display tube. Thus, the empty space within the fluorescent display tube can be effectively used.

There are two types of the wire getter 73, namely an evaporation type wire getter and a non-evaporation type wire getter. As an evaporation type getter, the getter formed of a metal linear member having the surface on which a getter material is coated, or the getter formed of a metal linear member having a groove which is filled with a getter material is used. The evaporation type wire getter is irradiated and heated by laser beams or by infrared rays to evaporate the getter material. Alternately, a voltage is applied between the Al thin films 711 and 712 fixing the wire getter 73 so that the getter material is evaporated by the resistance heating.

The non-evaporation type getters containing as a main component Zr, Ti, and Ta are known in the art. As a non-evaporation type wire getters, the getter material subjected to be in a linear shape or a getter material coated on the surface of a metal linear member is used. In a manner similar to that for the evaporation-type wire getter, the non-evaporation type wire getter is irradiated and heated by laser beams or by infrared rays or by resistance heating to activate the getter material so that gases are adsorbed.

The linear member, such as, the wire spacer 53, the wire damper 63, and the wire getter 73, shown in FIG. 8, can be provided by using the same ultrasonic bonding machine in a single step. Therefore, the linear member fixing work can be done effectively and easily.

In the embodiment explained hereinabove, the wire spacer is used as a cathode filament spacer and the wire damper is used as a cathode filament damper. However, the wire spacer may be used as a wire grid spacer and the wire damper may be used as a wire grid damper. In the linear member and the Al wire of fixing the linear member according to the above embodiments, it is desirable to set the ratio of the thickness of the linear member and the thickness of the Al wire to about 1:4. Although the example where both ends of the linear member are bonded to the Al wire which is, in turn, bonded to the Al film has been explained a metal, such as Cu, Au, or Ag, which is easily processed and bonded, may be used for the Al wires and the Al thin films in addition to aluminum (Al).

The Al wire is not necessarily a bonding wire. It may be in the form of a metal block which is capable of sustaining the linear member in a predetermined height. According to the present invention, the metal block and the Al wire is referred to as simply a metal spacer. The Al thin film may be made of a thick film metal layer. The thick film metal layer is referred to as simply a metal layer. It is to be understood that the metal layer can be formed on an electronic component disposed inside the hermetic container via an insulating layer. The electronic component may be made of the same material as that of the metal layer. It is desirable that the metal spacer and the metal layer are made of similar materials, such as, for example, Al or Al alloy in view of the bonding strength. It is most preferable to use the same metal, such as, for example, Al alloy for the metal spacer and for the metal layer.

In the above embodiment, the method of fixing linear members through ultrasonic bonding has been explained. However, other fixing methods, such as using a laser beam fixing method, may be employed. The fluorescent display tubes having a triode tube structure have been explained in the above embodiment. However, the fluorescent display tube may have a diode tube structure having no grids or a multi-electrode tube structure having two grids or more. Also, the fluorescent display tube having the linear members mounted to the first substrate has been explained. However, the liner members may be fixed to the second substrate or side plates inside the fluorescent display tube. It is to be understood that the linear members are not necessarily disposed in alignment with the outer ends of the metal spacer. The ends of the linear member may be protruded out from the metal spacer or may be positioned on the inside of the metal spacer.

Furthermore, the present invention is not limited to the fluorescent display tube. The present invention is applicable to electron tubes, such as, for example, a fluorescent luminous tube having fluorescent luminous elements with a large screen, a display tube such as a cathode-ray tube, a discharge tube such as a thermionic cathode discharge tube, and a vacuum electron tube which is provided with the linear members, such as for example, filaments, wire grids, wire spacers, wire damper, or wire getter, sustained in a predetermined height.

In the electron tubes of the present invention, the linear member is sustained in the predetermined height level while both ends thereof are fixed on the Al thin film metal layer. This structure can be effected with the single metal spacer, without disposing the height level holding member and the fixing member, which are required in the electron tube of the prior art. Therefore, the smaller space for disposing the height level holding member and the fixing member is required in the electron tube. Thus, the smaller size electron tube can be provided. According to the present invention, the height holding member and the fixing member can be made of a single metal spacer, which decreases the fixing steps and the number of components and reduces the fabrication costs of electron tubes. Also, the same ultrasonic bonding machine can be used to bond plural kinds of linear members in the single step. This permits the linear members to be fixed effectively and easily and the fixing work time can be shortened. In the electron tube of the present invention, each end of the linear member is inserted into the groove formed on the Al wire metal spacer. Thus, each end of the linear member can be fixed to the Al thin film metal layer having the metal spacer and the linear member securely bonded to each other. This permits the linear member to be easily fixed and displacement from the fixing position of the linear member to be decreased.

According to the present invention, the Al metal wires and linear members are arranged so as to orient the axes thereof in the same direction (in parallel). Accordingly the spacing between neighboring metal wire can be reduced. As a result, linear members such as filaments or wire grids can be arranged in a fine pitch. In an alternative embodiment, the Al metal wires and linear members are arranged so as to intersect the axes thereof. In this instance, it is not required to cut the metal wire in pieces. Accordingly, a large number of the filaments can be arranged in a fine pitch in a shorter working time. Further, the ultrasonic bonding used to bond the metal spacer does not generate heat. Therefore, the electron tube of the present invention is free from problems resulted from the heat generated during the manufacture of the electron tubes.

Obviously, many modification and variations of the present invention are possible in the light of the above teachings. It is therefore to be understood that within the scope of the appended claims, the invention may be practiced otherwise than as specifically described.

What is claimed is:

1. An electron tube comprising:

a hermetic container for containing electrodes therein;

linear members mounted inside said hermetic container;

a pair of metal spacers for keeping said linear members in a predetermined height in said hermetic container, said linear members being held by said metal spacers with at least one of said linear members having one end embedded in one of said metal spacers; and a pair of metal layers formed inside said hermetic container, said metal layers being bonded to said metal spacers.

2. The electron tube as defined claim 1, wherein each of said pair of metal spacers has a groove and wherein both ends of said linear member are inserted in said grooves, respectively.

3. The electron tube as defined in claim 1, wherein said metal spacers and said linear member are arranged in such a way that the axes of said metal spacers are in parallel to the axis of said linear member.

4. The electron tube as defined in claim 1, wherein said metal spacers and said linear member are arranged in such a way that the axes of said metal spacers intersects the axis of said linear member.

5. The electron tube as defined in claim 1, wherein said linear member comprises a cathode filament, a wire damper, a wire spacer, a wire grid, and a wire getter.

6. The electron tube as defined in claim 1, wherein said metal spacers are arranged in common for a plurality of linear members.

7. The electron tube as defined in claim 1, wherein said metal spacers are disposed at both ends of said hermetic container.

8. The electron tube as defined in claim 1, wherein said metal spacers are disposed in parallel with a side plate of said hermetic container.

9. An electron tube comprising:

a hermetic container for containing electrodes therein;

linear members mounted inside said hermetic container;

a pair of metal spacers for keeping said linear members in a predetermined height in said hermetic container, said linear members being held by said metal spacers to have at least a portion of both ends of said linear members embedded in said metal spacers; and a pair of metal layers formed inside said hermetic container, said metal layers being bonded to said metal spacers, wherein both ends of said linear member are ultrasonic bonded firmly with said metal spacers, respectively.

* * * * *